United States Patent [19]

Sayles

[11] Patent Number: 4,708,754

[45] Date of Patent: Nov. 24, 1987

[54] METHOD OF GENERATING CROSSLINKING SITES ON THE SURFACE OF AMMONIUM PERCHLORATE IN SOLID INTERCEPTOR PROPELLANTS

[75] Inventor: David C. Sayles, Huntsville, Ala.

[73] Assignee: The United States of America as represented by the Secretary of the Army, Washington, D.C.

[21] Appl. No.: 10,021

[22] Filed: Feb. 2, 1987

[51] Int. Cl.[4] ..... C06B 45/22

[52] U.S. Cl. ..... 149/11; 149/19.4; 149/19.9; 149/76; 149/109.6

[58] Field of Search ..... 149/11, 19.4, 19.9, 149/76, 109.6

[56] References Cited

U.S. PATENT DOCUMENTS

| | | | |
|---|---|---|---|
| 4,000,023 | 12/1976 | Oberth et al. | 149/19.4 |
| 4,482,406 | 11/1984 | Stephens et al. | 149/19.9 |
| 4,482,407 | 11/1984 | Stephens et al. | 149/19.9 |
| 4,482,408 | 11/1984 | Stephens et al. | 149/19.9 |
| 4,482,409 | 11/1984 | Stephens et al. | 149/19.9 |
| 4,493,741 | 1/1985 | Ducote et al. | 149/19.9 |
| 4,531,989 | 7/1985 | Ducote et al. | 149/19.4 |

*Primary Examiner*—Stephen J. Lechert, Jr.

*Attorney, Agent, or Firm*—John C. Garvin, Jr.; Freddie M. Bush

[57] ABSTRACT

A method of generating reactive crosslinking sites on the surface of the ammonium perchlorate particles contained in a Catocene-catalyzed, high-burning rate solid propellant composition by a processing agent which also results in a major improvement in the processibility thereof. The fluid state of the propellant is retained during mixing as a result of interaction between the processing agent prepared prior to incorporating it or when the processing agent is prepared in situ during the propellant mix cycle. There are two alternates available toward improving the processibility of Catocene-catalyzed, high-burning rate propellants. These are: a. The synthesis of a condensation product (processing agent) by the interaction at room temperature of 1,3,5,7,9-pentaazanonane, acrylonitrile, oxiranylmethanol and octadecyl isocyanate in predetermined ratios; or b. Incrementally adding the octadecyl isocyanate to the propellant mix which incorporates the glycidol reaction product of cyanoethyl-substituted tetraethylenepentamine (Tepanol). A major improvement in processing can be effected as a result of the additions of octadecyl isocyanate in 1,2, or 3 increments to the Tepanol-containing mix.

3 Claims, 3 Drawing Figures

METHOD OF GENERATING CROSSLINKING SITES ON THE SURFACE OF AMMONIUM PERCHLORATE IN SOLID INTERCEPTOR PROPELLANTS

DEDICATORY CLAUSE

The invention described herein may be manufactured, used, and licensed by or for the Government for governmental purposes without the payment to me of any royalties thereon.

BACKGROUND OF THE INVENTION

Bonding agents have been developed for coating the surface of ammonium perchlorate particles. Bonding agents for broad and specific uses have been developed to achieve certain end results. One example of a bonding agent and its benefit is MT4 (reaction product of 2.0 moles of tris-1-(2-methylaziridinyl)phosphine oxide, 0.7 mole adipic acid, and 0.3 mole tartaric acid), HX752 (bis-isophthaloyl-1-(2-methylaziridine), and BIDE (butyliminodiethanol) in combinations of 0.10% to 0.20%, 0.10% to 0.12%, and 0.02% to 0.05% weight percent range respectively of a hydroxy-terminated polybutadiene propellant composition to achieve improved propellant aging and low temperature physical properties. Other bonding agents such as BA114, the reaction product of equimolar quantities of 12-hydroxystearic acid and tris[1-(2-methylazirdinyl)]phosphine oxide, have also imparted very desirable mechanical properties to composite propellants.

Other types of compounds including certain amine compounds such as TEPAN, partially cyanoethylated tetraethylene pentamine, have long been used in the propellant industry as bonding agents in composite propellants containing ammonium perchlorate (AP). They greatly improve the mechanical properties of such propellants by chemically bonding AP particles to the binder matrix. TEPAN is also known to facilitate processing relative to other bonding agents since the mix viscosity of the propellant is not increased as much by TEPAN as it is by most other bonding agents.

The glycidol reaction product of cyanoethyl-substituted tetraethylenepentamine or Tepanol has been employed as a bonding agent for polyurethane propellants containing ammonium perchlorate as the oxidizing agent.

Adducts of TEPAN and TEPANOL are disclosed in U.S. Pat. No. 4,493,741 along with their preparation as polyamine salt adduct bonding agents which produce equal or superior physical properties in HTPB composite propellants as compared to the parent compounds. These polyamine salt adduct bonding agents are prepared by adding a distilled water solution of the selected salt, e.g., ammonium sulfate (AS), ammonium formate (AF) or ammonium perchlorate (AP), to TEPAN or TEPANOL with stirring and heating, and subsequent evaporation of the volatiles. The polyamine salt adduct bonding agents are recovered as products having from about 25 to about 36 percent of the reactive amine groups of TEPAN or TEPANOL reacted with the ammonium ion of the ammonium salt selected.

U.S. Pat. No. 4,531,989 employs the polyamine salt adduct bonding agents of U.S. Pat. No. 4,493,741 in a polyester binder propellant composition wherein because of its insolubility in the polyester binder it is effective in improving mechanical properties. Unlike hydroxy-terminated polybutadiene wherein a bonding agent is solubilized and still can function as a bonding agent for inorganic ammonium oxidizer salts in the propellant matrix, polyester binders that solubilize the bonding agent renders the bonding agent ineffectual as a bonding agent.

The mechanism for polyamine salt adduct bonding agent in polyester binder requires the bonding agent to be finely dispersed since it is driven to the inorganic oxidizer salt surfaces where it homopolymerizes around or reacts with a second reactant, usually the propellant curative to form a shell which will subsequently react with the binder thus chemically reinforcing the binder-/inorganic oxidizer salt matrix.

Although bonding agents have been found to be effective for certain binder systems, the use of other ingredients can render the bonding agent ineffective. A case in point is the preferred bonding agent, Tepanol, which is in near-general use within the propulsion community. Tepanol has been determined to be ineffective when used in a 2,2-bis(ethylferrocenyl)propane(-Catocene)-catalyzed, high-burning rate composite propellants. Tepanol's ineffectiveness is evident from the results observed when it is used in a catocene-catalyzed, high-burning rate composite propellant composition wherein it fails to function as a propellant processing aid, and the propellant mix becomes very dry, stiff and lumpy with inadequate flow to be acceptably processible.

Therefore, an object of this invention is to provide a modification to the glycidol adduct of a partially cyanoethylated tetraethylenepentamine (Tepanol) wherein the "dry stage" in propellant processing which results from the hydrogen bonding of the Tepanol-coated ammonium perchlorate surfaces and the dewetting of the nonpolar prepolymer chain is prevented from taking place.

A further object of this invention is to provide a processing reagent which not only improves propellant processing of Catocene but functions in the propellant composition wherein used to generate crosslinking sites on the surface of ammonium perchlorate in solid interceptor propellants to improve elongation of the propellant.

SUMMARY OF THE INVENTION

The processibility of Catocene-catalyzed, high-burning rate propellants is improved by incorporating a synthesized condensation product formed by the interaction of 1,3,5,7,9-pentaazanonane, acrylonitrile, oxiranylmethanol, and octadecyl isocyanate in the ratios contained in Table I below.

TABLE I

Composition Of Catocene-Catalyzed Propellant Processing Reagent

| Ingredient | Weight |
|---|---|
| 1,3,5,7,9-Pentaazanonane | 798 |
| Acrylonitrile | 2466 |
| Oxiranylmethanol | 954 |
| Octadecyl Isocyanate | 281 |
| Total | 4499 |

The above ingredients are combined in the weight ratios shown to form a blend; the blend is allowed to stand at room temperature for an hour until the heat generated in the reaction has dissipated. The processing aid in an amount from about 0.1 weight-percent to about 0.4 weight percent is combined with a solid propellant composition of approximately 88% solid ingredients (consisting of aluminum powder, and ammonium perchlorate blend of ultrafine and fine-sized particles), and of about 12 weight-percent liquid ingredients comprised of a hydroxy-terminated polybutadiene prepolymer containing an isocyanate curative of a mixture of isophorone disocyanate (IPDI) and a trifunctional isocyanate (N100), Catocene burning rate catalyst, and an optional plasticizer.

Alternately, the processing reagent can be formed in the propellant composition, in situ, by incrementally adding from about 0.05 weight percent to about 0.1 weight percent of octadecyl isocyanate to the propellant mix which has from about 0.1 weight percent to about 0.4 weight percent of Tepanol incorporated therein. A major improvement in processing can be effected as a result of the addition of octadecyl isocyanate in 1,2, or 3 increments to the Tepanol-containing mix.

DESCRIPTION OF THE PREFERRED EMBODIMENT

Figure 1:
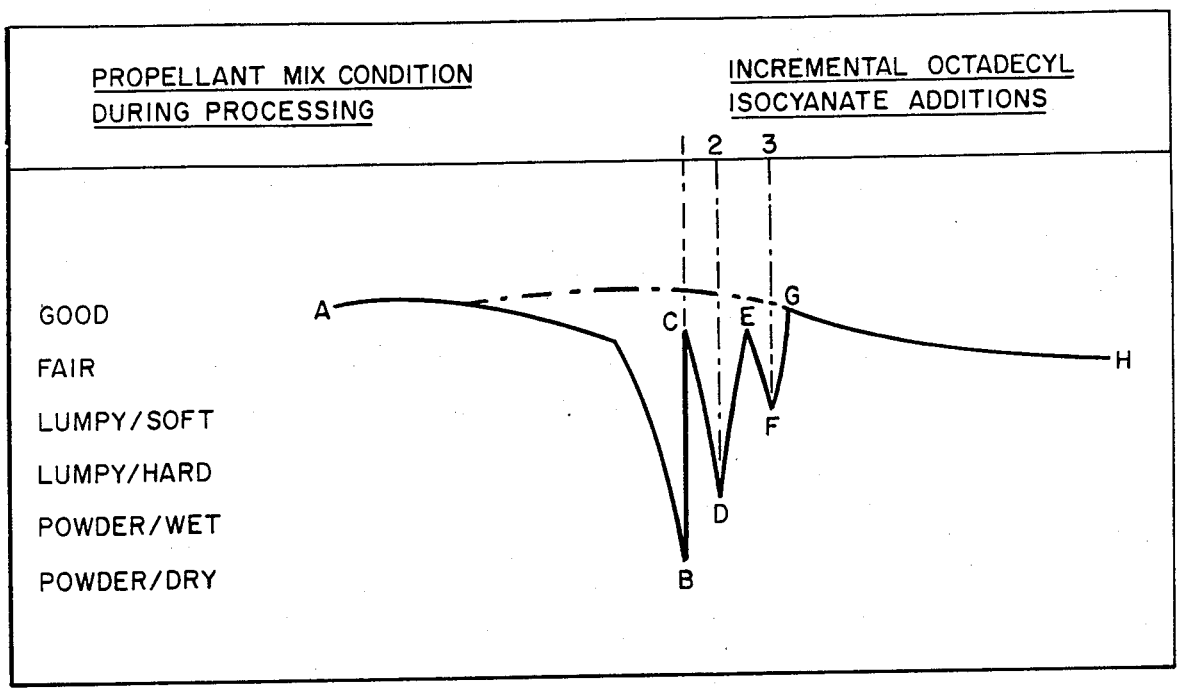
FIG. 1 of the drawing depicts the various effects of incremental additions of octadecyl isocyanate on processing stages that Catocene-catalyzed propellants undergoes when Tepanol alone is used and when the processing stages are restored by incremental addition of processing agent.

The condensation product formed by the interaction of 1,3,5,7,9-pentaazanonane, acrylonitrile, oxiranylmethanol, and octadecyl isocyanate yields a processing agent for Catocene-catalyzed propellants. The processing agent can be prepared prior to incorporating it into a Catocene-catalyzed propellant composition. When the processing agent is prepared prior to incorporating into propellant, a small amount of octadecyl isocyanate (0.01%) is added to propellant mix to function as an ammonia scavenger. An alternate means of producing the processing agent is to incorporate Tepanol into a Catocene-catalyzed propellant composition and then make incremental additions of octadecyl isocyanate which reacts with Tepanol to produce the processing agent in the propellant in situ. Refer to FIG. 1 which depicts incremental additions 1,2, and 3 and their effect to curve A,B,C,D,E,F,G, and H. Thus, the condensation product of Tepanol and octadecyl isocyanate is the same product that is produced when the condensation product is formed from the interaction of 1,3,5,7,9-pentaazanonane, acrylonitrile, oxiranylmethanol, and octadecyl isocyanate.

The structural formula of the processing agent for a catocene-catalyzed propellant is shown below. Refer to Table I which lists the composition of the processing agent.

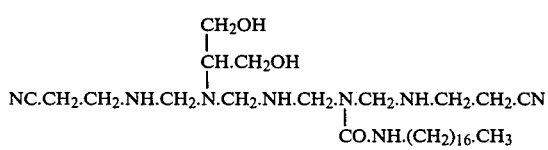

The processing reagent of this invention when prepared prior to propellant mixing and for adding to the propellant is the condensation product of the ingredients of Table I which are combined to form a blend. The blend is allowed to stand at room temperature for an hour prior to use so that heat generated in the reaction is dissipated.

Explanations and Comparisons of Mechanisms of Processing Reagent Function With Tepanol The effectiveness of this processing reagent as a batch processing aid with Catocene-catalyzed propellants is due to the fact that it provides a means of introducing nonpolar molecular chains which have affinity for the binder prepolymer. This causes the propellant mix to remain fluid during the mixing stages whereas, otherwise, the mix would become very stiff and lumpy. A qualitative depiction of this phenomenon appears in FIG. 1.

This processing agent functions in a manner which is completely different from the bonding agent Tepanol which has the same composition minus octadecyl isocyanate. It is the glycidol reaction product of cyanoethyl-substituted tetraethylenepentamine which is commonly known by the acronym, Tepanol. The primary difference in behavior of Tepanol bonding agent and this processing agent is in the change in the chemistry of the interaction which occurs at the interface with the ammonium perchlorate particles.

When Tepanol is coated onto the surface of an ammonium perchlorate particle, a nonpolar-to-polar interaction occurs. Because of the difference in polarity, the wet-out between the ammonium perchlorate particle and the Tepanol bonding agent is limited. This is graphically depicted in FIG. 2.

Figure 3:
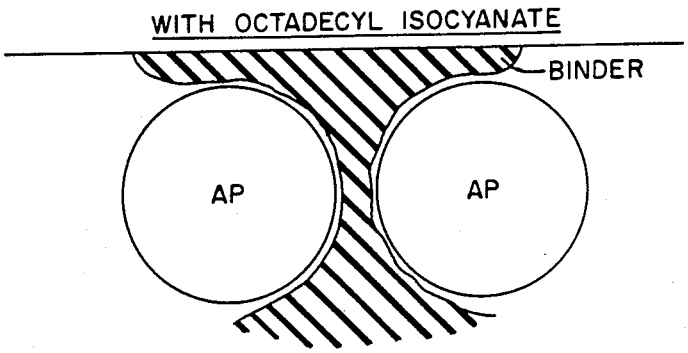

By contrast, as shown in FIG. 3, when the ammonium perchlorate particles are coated with this processing reagent, the interaction between it and the prepolymer is completely nonpolar, and affinity between these two components is greatly increased with the concurrent improvement in wet-out during propellant processing. The nonpolar molecular moieties of the octadecyl functional group, because of it prepolymer affinity, help the propellant mix to remain in the semi-fluid state. A qualitative depiction of this interaction is shown in FIG. 1, in which the processing stages of a propellant mix are depicted.

FIG. 1 depicts the various processing stages that a propellant would go through if Tepanol were used as the bonding agent. At the outset of mixing, processing would be good; but it would rapidly change to fair, then lumpy soft, then lumpy hard and not processible (A–B) with the incremental addition of octadecyl isocyanate, processibility is restored (B–C) for a short time, and then again becomes lumpy and hard. Incremental additions of octadecyl isocyanate at B, D, F restores the processibility to an acceptable level. After an adequate amount of octadecyl isocyanate has been introduced into the propellant mix, good processibility remains until the mixing is complete.

When this processing agent is incorporated into the propellant at the outset of mixing, processibility remains good throughout the entire mix cycle, and follows the AGH route of the curve depicted in FIG. 1 and also results in a considerable shortening of the mix cycle.

When using the processing agent prepared by prereacting octadecyl isocyanate with 1,3,5,7,9-pentaazanonane, acrylonitrile and oxiranylmethanol, the propellant mix remains in the fluid state even when the octadecyl isocyanate content is reduced to a level of more than 60% less than when it was incrementally added to propellant mixes containing Tepanol-coated ammonium perchlorate particles to form the processing agent in situ.

The explanation for this difference in behavior is that, when octadecyl isocyanate is added to the Tepanol-containing propellant mix, part of it undergoes reaction with the ultrafine ammonium perchlorate and, as a result, the several additions which are required with the Tepanol mix for it to remain in the fluid state results in the use of more octadecyl isocyanate to achieve the desired fluid state during mix.

Figure 2:
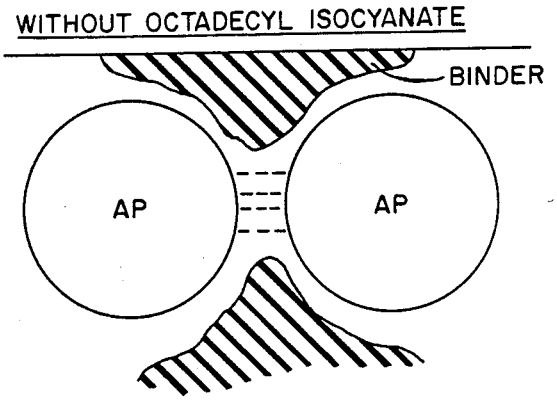
FIGS. 2 and 3 of the drawing depicts the differences in orientation of prepolymer around Tepanol-treated ammonium perchlorate particles with and without octadecyl isocyanate.

FIGS. 2 and 3 present a depiction of the apparent differences in the effects of Tepanol and this processing agent in its orientation around the ammonium perchlorate particles. Further evaluations indicate that propellant properties, particularly the elongation of the propellant are improved as a result of the orientation of the polymer around the AP particles.

I claim:

1. A method of generating reactive crosslinking sites on the surface of the ammonium perchlorate particles contained in a high-burning rate solid propellant composition comprised of about 88 weight percent solid portion and of about 12 weight percent liquid portion, said solid portion comprised of ultrafine and fine ammonium perchlorate in a proportion ratio of about 90 parts to about 10 parts of aluminum powder, said liquid portion comprised of hydroxy-terminated polybutadiene propolymer containing an isocyanate curative of a mixture of isophorone diisocyanate and a trifunctional isocyanate, said method comprising:

(i) combining the following ingredients A,B,C, and D in weight ratios of 798, 2466, 954, and 281 respectively to form a blend, said ingredient A being 1,3,5,7,9-pentaazanonane, said ingredient B being acrylonitrile, said ingredient C being oxiranylmethanol, and said ingredient D being octadecyl isocyanate;

(ii) allowing said blend to react for about one hour at room temperature to form the processing agent having the structural formula:

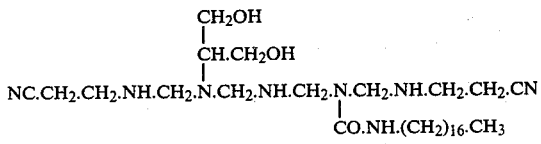

said processing agent being further defined as the condensation product of octadecyl isocyanate and the glycidol reaction product of cyanoethyl-substituted tetraethylenepentamine;

(iii) adding an effective amount from about 0.1 weight percent to about 0.4 weight percent of said processing agent to said high-burning rate solid propellant during the mixing of said propellant wherein said processing agent coats said ammonium perchlorate to achieve a nonpolar interaction between said processing agent and said propellant prepolymer to cause propellant mix to remain fluid during mixing cycle and to additionally result in a considerable shortening of the mixing cycle as compared with a mixing cycle where no processing agent is used, and wherein reactive crosslinking sites are generated on surface of said ammonium perchlorate as a result of said coating.

2. The method of claim 1 wherein an additive of about 0.01 weight percent of octadecyl isocyanate is added to said propellant composition following the adding of said processing agent wherein said additive of about 0.01 weight percent of octadecyl isocyanate function as an ammonia scavenger.

3. A method of generating reactive crosslinking sites on the surface of the ammonium perchlorate particles contained in a high-burning rate solid propellant comprised of about 88 weight percent solid portion and of about 12 weight percent liquid portion, said solid portion comprised of untrafine and fine ammonium perchlorate in a proportion ratio of about 90 parts to about 10 parts of aluminum powder, said liquid portion comprised of hydroxy-terminated polybutadiene prepolymer containing an isocyanate curative of a mixture of isophorone diisocyanate and a trifunctional isocyanate, said method comprising:

(i) incorporating into said high-burning rate solid propellant composition an effective amount from about 0.1 weight percent ot about 0.4 weight percent of the glycidol reaction product of cyanoethyl-substituted tetraethylene pentamine;

(ii) incrementally adding into said high-burning solid propellant composition containing said glycidol reaction product of cyanoethyl-substituted tetraethylenepentamine from about 0.05 weight percent to about 0.1 weight percent of octadecyl isocyanate which is effective in achieving a major improvement in propellant processing as a result of a reaction between said octadecyl isocyanate, said ultrafine ammonium perchlorate, and said propellant prepolymer to cause propellant mix to remain fluid during mixing cycle and to additionally result in a considerable shortening of the mixing cycle as compared with a mix cycle when no processing agent is used and wherein reactive crosslinking sites are generated on surface of said ammonium perchlorate as a result of said reaction.

* * * * *